United States Patent [19]

Sweet

[11] Patent Number: 4,626,223

[45] Date of Patent: Dec. 2, 1986

[54] TOY VEHICLE ASSEMBLY

[75] Inventor: Roger H. Sweet, Long Beach, Calif.

[73] Assignee: Mattel, Inc., Hawthorne, Calif.

[21] Appl. No.: 775,552

[22] Filed: Sep. 13, 1985

[51] Int. Cl.[4] ..... A63H 13/00

[52] U.S. Cl. ..... 446/279; 446/470

[58] Field of Search ..... 446/268, 269, 275, 279, 446/280, 286, 288, 465, 470, 457, 462, 473, 437, 6, 441; 280/43; 180/209

[56] References Cited

U.S. PATENT DOCUMENTS

| | | | |
|---|---|---|---|
| 2,092,388 | 9/1937 | Caulkins . | |
| 2,597,094 | 5/1952 | Gutmann | 446/6 |
| 2,605,117 | 7/1952 | Hooz et al. . | |
| 3,581,435 | 6/1971 | Wingrove . | |
| 4,087,931 | 5/1978 | Maurer | 446/280 |
| 4,248,006 | 2/1981 | Jones et al. . | |
| 4,391,060 | 7/1983 | Nakane . | |
| 4,556,397 | 12/1985 | Arad et al. | 446/437 |

FOREIGN PATENT DOCUMENTS

| | | | |
|---|---|---|---|
| 2085739 | 5/1982 | United Kingdom . | |
| 2130495 | 6/1984 | United Kingdom | 446/279 |

*Primary Examiner*—Mickey Yu

*Attorney, Agent, or Firm*—Ronald M. Goldman; Melvin A. Klein; Daniel F. Sullivan

[57] ABSTRACT

A toy vehicle including first and second frame members that can be transformed into different positions from a first position which the frame members are in a planar position to a second position in which the frame members are pivoted relative to one another to assume an elevated position. An actuating mechanism including a sliding member to engage and disengage the frame members and a coil spring to urge the frame members into the pivoted elevated position.

7 Claims, 5 Drawing Figures

TOY VEHICLE ASSEMBLY

BACKGROUND OF THE INVENTION

1. Field of the invention:

The present invention is directed to a toy vehicle capable of changing its shape and mode of operation and more particularly to a mobile toy assembly that can be reconfigured from a first action toy vehicle into a second action toy vehicle in a controlled manner.

2. Description of the prior art:

It is well known in the toy industry to provide for a number of designed mobile toys. These toys can be taken apart and assembled by a young child as described for example in U.S. Pat. No. 4,248,006. There are still other toys that can be assembled together to form different figures or structures, but may be used as separate components as described for example in U.S. Pat. No. 4,391,060. U.S. Pat. No. 4,248,006 describes a reconfigurable moving toy with upper and lower body sections. U.S. Pat. No. 2,605,117 shows a collapsible hand truck device.

BRIEF DESCRIPTION OF THE INVENTION

With the instant invention a toy vehicle is provided for use with a toy figure or the like in which the vehicle can be transformed into different configurations by a young child to enable a variety of playing positions for the toy figure and toy vehicle for amusement. The toy vehicle has a first frame member which includes a deck support by at least one wheel. The toy figure is placed in a parallel relationship with the deck. A second frame member having at least one wheel is pivotaly connected to the first frame member on an axis parallel to the axis of the wheels. The first and second frame members have a first position in which the frame members are in a planar position with the frame members extended longitudinally such that the toy figure will be lying in a prone position. The frame members can be transformed into a second position in which the frame members are pivoted relative to one another on an axis parallel to the wheels to provide an elevated structure in which the toy figure is in the standing position. The different positions for the frame members are accomplished by an actuating means that is housed below the deck in the first frame member for enabling the pivoting action to move the first and second frame members from their first position to their second position.

DESCRIPTION OF THE PREFERRED EMBODIMENT

Figure 1:
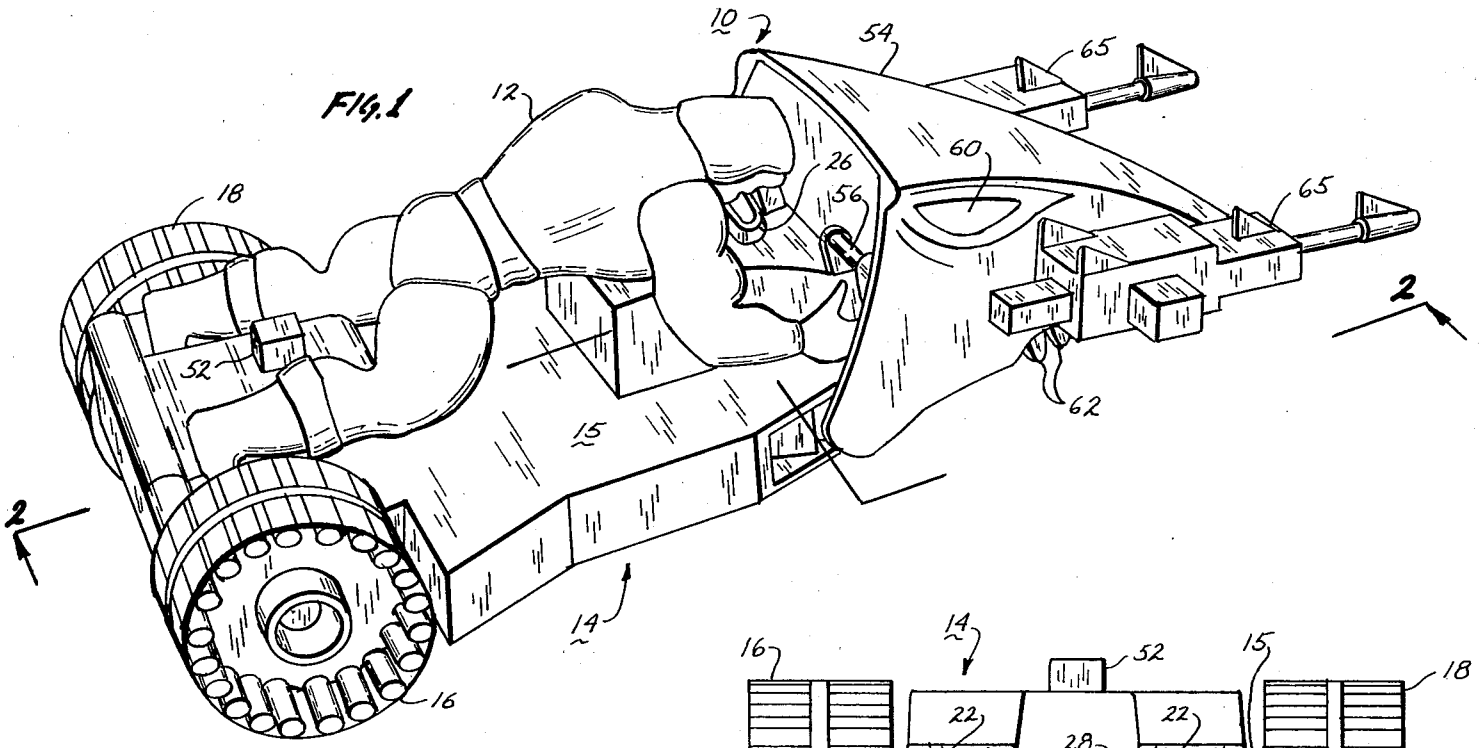
FIG. 1 is a perspective view of the toy vehicle according to the invention in which the toy vehicle and the toy figure associated therewith are in a lieing position.
Figure 3:
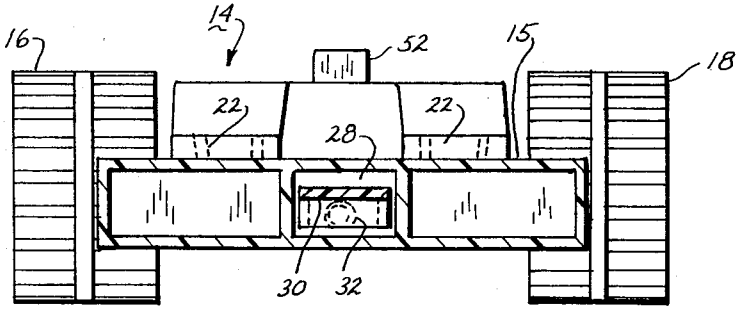
FIG. 3 is a sectional view taken along lines 3—3 of FIG. 2.
Figure 2:
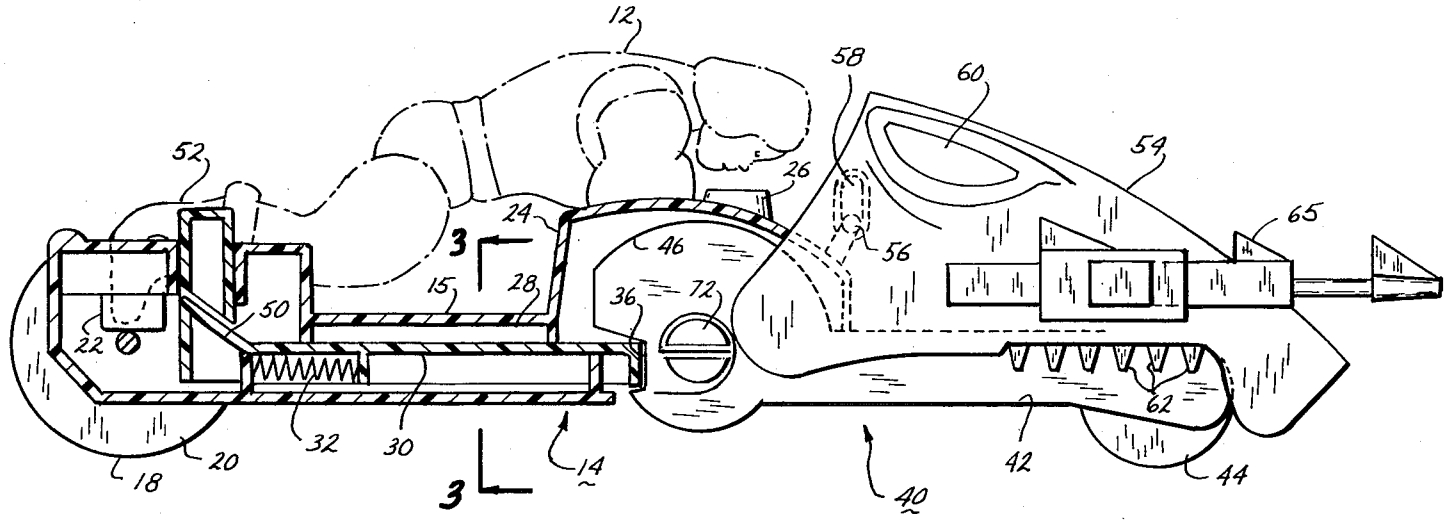
FIG. 2 is a sectional view taken along lines 2—2 of FIG. 1.

Referring now to FIGS. 1–3 there is shown a toy vehicle according to the invention generally designated 10. The toy vehicle 10 has a toy figure 12 positioned on top thereof to simulate the operation and control of the toy vehicle. Toy vehicle 10 includes a frame member 14 that includes a deck 15 that is supported by a pair of wheels 16 and 18 that are mounted thereto for rotation about an axle 20. Frame member 14 supports the feet of the toy figure 12 by having a pair of recesses 22 formed in the frame member and then having a hollow raised portion 24 for supporting the upper body of the toy figure. The portion 24 includes a simulated viewing area portion 26 through which the toy figure may be looking to give the appearance for controlling the operation of the vehicle. The frame member 14 is formed with a cavity 28 in which a sliding member 30 is received. Sliding member 30 is urged into a position by a spring member 30 so that the leading end 34 of member 32 can be received by a notch 36 formed in a frame member 40. Frame member 40 is pivotly mounted on an axis 42 to the frame member 14. The frame member 40 includes an elongated rod portion 42 that has a single wheel member 44 positioned at the forward end thereof for supporting the vehicle. At the opposite end of frame member 40 from wheel 44 is a curved portion 46 that is received inside portion 24. The sliding member 30 has a rear inclined portion 50 that is adapted for use as a cam follower surface engadged by a cam member 52. Cam member 52 is moveable in an up and down direction for movement relative to the frame member 14 for a purpose to be described. Pivotly mounted on frame member 40 is a head member 54 pivotable on a pair of pins 56 supported on portion 24. Each of the pins is received in an elongated groove 58 formed in the inside of head member 54 (FIG. 2). The head member 54 is supported at its forward end over the wheel member 44. The head member 54 has eyes 60 and teeth 62 to simulate the appearance of a monster. Also included on the head member 54 are armaments 65.

Figure 4:
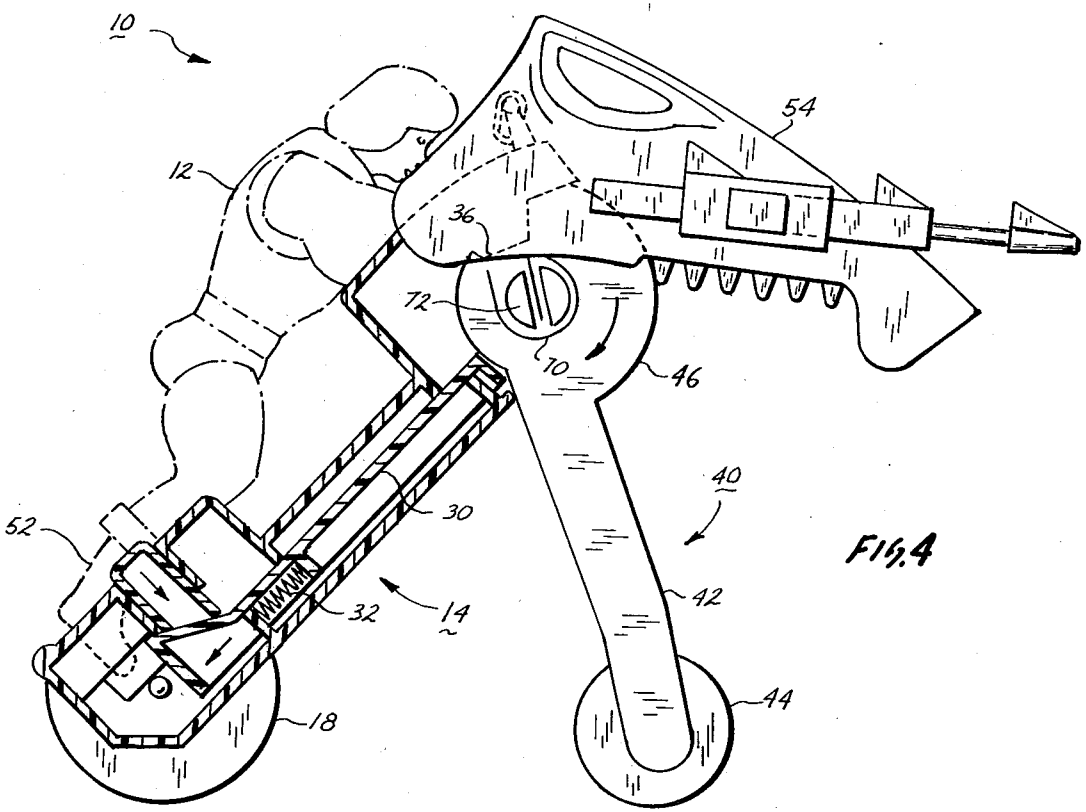
FIG. 4 is a side elevation view of the toy vehicle according to the invention in an elevated position with the toy figure associated therewith in a standing position.
Figure 5:
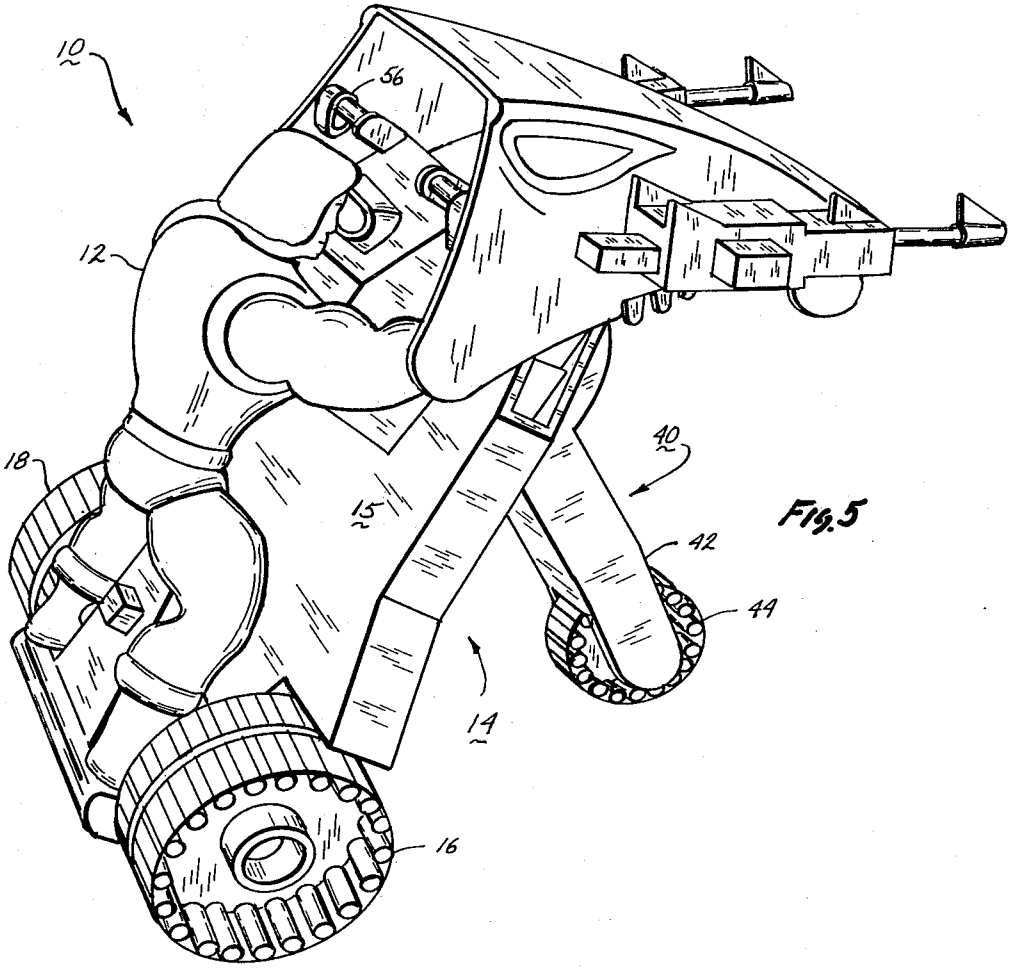
FIG. 5 is a perspective view of the toy vehicle and toy figure in the elevated position shown in FIG. 4.

Upon movement in a downward direction of cam member 52 against the inclined portion 50 of the sliding member 30, the sliding member 30 is caused to be pulled to the rear against the action of the spring member 32. As a result end 34 is moved out of the engagment with notch 30 of the frame member 40. When this occurs the frame members 14 and 40 are caused to pivot upwardly relative to one another by the action of a coil spring 70 encircling an axis of a pin member 72 resulting in the frame members 14 and 40 being raised into an elevated position. In this position as shown in FIGS. 4 and 5 the wheel members are closer together and the vehicle is elevated. It will be observed that the toy figure is now in a standing position and that the toy vehicle has been transformed into a new and different configuration for the amusement of a child. Upon pushing the frame members 14 and 40 in a downward direction, the coil spring 70 is overcome and the sliding member 30 is urged into engagement with notch 36 due to the action of spring members 32.

It will now be appreciated that the toy vehicle according to the invention provides amusement for a young child for play with a toy figure. The toy vehicle can be transformed easily into different positions simulating different controls by the toy figure aboard the vehicle.

The above description describes the preferred embodiments of the present invention, however, persons of ordinary skill in the toy field are capable of numerous modifications once taught these principles. Accordingly, the present invention should be determined solely from the following claims.

I claim:

1. A toy vehicle for use with a toy figure in which the vehicle is transformed into different configurations by a young child for a variety of play comprising:

a first frame member including at least one wheel member and a deck member upon which a toy figure is positioned in a parallel relationship therewith;

a second frame member pivotally connected to the first frame member on a horizontal axis, said second frame member having at least a single wheel connected to one end thereof;

said first and second frame members having a first position in which said first and second frame members are positioned in a planar position with the frame members extended longitudinally and with the toy figure positioned in a prone position, and a second position in which said first and the second frame members are pivoted relative to one another to provide an elevated structure with the wheel members closer together and toy figure in a standing position; and actuating means housed below the deck member in said first frame member for releasing engagement of the first end and second frame members and causing pivotal relative movement of the frame members on said horizontal axis parallel to axes of the wheel members to move the frame members from their first position to their second position.

2. A vehicle according to claim 1 wherein said actuating means includes a member that is slidable in a longitudinal direction, said member being urged by a compression spring member to engage a notch formed in said second frame member said slidable member becoming disengaged upon sliding movement of the slidable member against the compression spring member, and a coil spring member encircling the pivot axis of the frame members.

3. A toy vehicle according to claim 1 wherein said second frame member includes a member in the shape of a head at the forward end of the vehicle, said head member being pivotly mounted for movement relative to said first and second frame members.

4. A toy vehicle according to claim 3 wherein said head has the appearance and shape of a monster with eyes and teeth.

5. A toy vehicle according to claim 2 wherein said second frame member is an elongated rod supported by a single wheel at one end thereof.

6. A toy vehicle according to claim 1 wherein said toy figure has a head, an upper torso and a lower torso with feet and said first frame member is formed with a pair of recesses to receive the feet of the toy figure.

7. A toy vehicle according to claim 6 wherein said first frame member includes a simulated viewing area portion in the vicinity of the head of the toy figure.

* * * * *